United States Patent [19]

Figliuzzi

[11] Patent Number: 4,614,169

[45] Date of Patent: Sep. 30, 1986

[54] ULTRA HIGH COMPRESSION ENGINE

[76] Inventor: Vincent D. Figliuzzi, 315 S. Kenilworth, Elmhurst, Ill. 60126

[21] Appl. No.: 703,460

[22] Filed: Feb. 21, 1985

Related U.S. Application Data

[63] Continuation of Ser. No. 502,516, Jun. 9, 1983, abandoned.

[51] Int. Cl.[4] ..... F02B 75/26

[52] U.S. Cl. ..... 123/54 R; 123/56 BC; 123/56 C; 123/197 AC

[58] Field of Search ..... 123/197, 51, 56, 59

[56] References Cited

U.S. PATENT DOCUMENTS

| | | | |
|---|---|---|---|
| Re. 26,222 | 6/1967 | Fielder | 123/56 BC |
| 630,229 | 8/1899 | Hoyt | 123/54 R |
| 844,836 | 2/1907 | Treen | 123/54 R |
| 874,200 | 12/1907 | Hoyt | 123/54 R |
| 1,190,949 | 7/1916 | Philippe | 123/55 AA |
| 1,698,598 | 1/1929 | Kussner | 123/56 AB |
| 1,774,105 | 8/1930 | Neldner | 123/56 BC |
| 3,285,503 | 11/1966 | Bancroft | 123/56 R |
| 3,517,652 | 6/1970 | Albertson | 123/56 R |
| 3,520,285 | 7/1970 | Klauder | 123/56 BA |
| 3,946,706 | 3/1976 | Pailler | 123/56 BC |
| 4,078,439 | 3/1978 | Iturriaga-Notario | 123/56 BC |

FOREIGN PATENT DOCUMENTS

| | | | |
|---|---|---|---|
| 0085514 | 2/1936 | Sweden | 123/56 BB |
| 447472 | 5/1936 | United Kingdom | 123/56 C |

*Primary Examiner*—Craig R. Feinberg

*Attorney, Agent, or Firm*—Hill, Van Santen, Steadman & Simpson

[57] ABSTRACT

A reciprocating piston machine, such as an internal combustion engine, is provided with a piston translator arrangement operated by a pair of oppositely rotatable crankshaft means disposed on opposed sides of the cylinder longitudinal axis such that the piston moves in a true straightline motion. This arrangement enhances ultimately possible compressions and improves operating efficiency since debilitating cylinder sidewall pressure by the piston is eliminated and forces are carried by two shaft systems, instead of one. An arrangement for removal of the piston from the cylinder, uniquely adapted for straightline motion piston running, is also disclosed.

19 Claims, 13 Drawing Figures

ULTRA HIGH COMPRESSION ENGINE

This is a continuation of application Ser. No. 502,516, filed June 9, 1983 now abandoned.

BACKGROUND OF THE INVENTION

The invention relates to reciprocating piston machines, such as fluid pressure engines, compressors, and pumps, and, more particularly, to an eccentric-cam type transmission mechanism for connecting the reciprocating piston of an internal combustion engine to a rotating drive shaft such that the piston moves in true straightline fashion along the longitudinal axis of the cylinder.

Conventional crankshaft drive transmissions for the reciprocating piston of a fluid pressure machine, such as an internal combustion engine, have connecting rod angularity relative to the longitudinal axis of the piston cylinder in moving the piston back and forth within the cylinder. This angled force acting on the piston causes the piston to experience sidewall pressure due to piston engagement of the cylinder wall, which sidewall pressure leads to destruction of the cylinder wall oil film and creates a rubbing friction retarding movement of the piston. This rubbing action on the piston reduces the ultimate compression ratio and leads to a decrease in horsepower efficiency.

It is further typical for the drive transmission of a reciprocating piston engine to utilize a single crankshaft throw per piston, thus limiting the ultimately achievable compression ratio to that which can be safely carried by the single crankshaft.

The present invention offers a transmission mechanism for a reciprocating piston which eliminates connecting rod angularity and permits higher compression to be obtained, which translates into better efficiency and greater horsepower, in the case of an internal combustion engine. The present invention also provides for a simplified arrangement for separately removing a piston from a cylinder, such as to replace piston seal rings, which arrangement is permitted by virtue of the straightline motion of the piston in the cylinder.

SUMMARY OF THE INVENTION

In a reciprocating piston machine, such as an internal combustion engine, the undersurface of the piston is connected with a translator element disposed for true straightline motion within a longitudinal plane of the piston cylinder. A pair of oppositely rotatable crankshaft means are disposed on opposite sides of the longitudinal axis of the cylinder, each having an eccentric arm intersecting with the longitudinal plane of the cylinder. A pair of cam means are respectively connected between each eccentric arm and the translator element on opposite sides of the cylinder longitudinal axis and relatively movable of the translator element for imparting back and forth straightline motion to the translator element. The cam means may be in the form of a disc journaled for rotation in the translator element and eccentrically rotated by a respective eccentric arm. Alternatively, the cam means may be in the form of a pair of connecting rods disposed on opposite sides of the translator element and pin connected for rotation at one end with the translator element and at the other end with the respective eccentric arm. Further, the cam means may be in the form of a slider disposed for lateral movement along a laterally directed track formed in the translator element. The inventive arrangement may be used to reciprocate a single piston or operate an opposed pair of pistons coupled to the translator element.

Further, in accordance with the invention, a reciprocating piston machine having true straightline piston motion within the cylinder may be provided with removable cylinder head surfaces to facilitate the replacement of the piston and/or piston rings. In this arrangement, the piston head is removably secured to the translator element within the cylinder and a special tool for threadably engaging the detached piston may be used to lift the piston head out of the cylinder for maintenance or replacement.

DESCRIPTION OF THE PREFERRED EMBODIMENT

Figure 1:
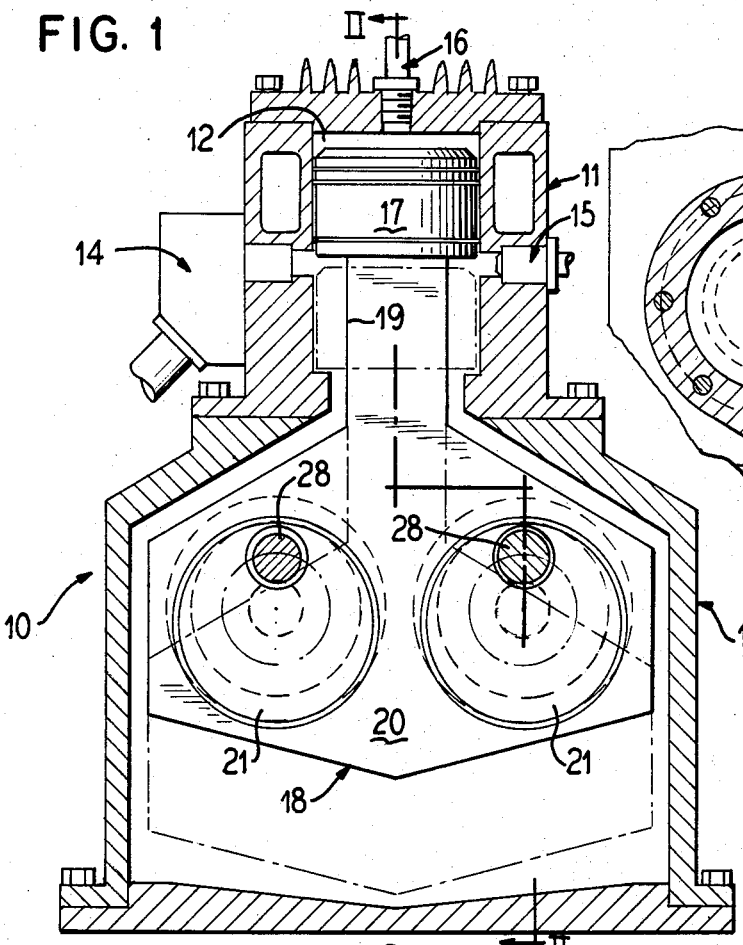
FIG. 1 is a cross-sectional side elevational view of an internal combustion piston engine constructed in accordance with a first embodiment of the invention.

FIGS. 1–10 concern an inventive transmission mechanism for connecting the reciprocating piston or pistons of an internal combustion engine to a rotating driveshaft, such that the piston or pistons are effected with a true straightline movement along the longitudinal axis of its respective cylinder. In other words, no force component angled relative to the longitudinal axis of the cylinder is applied to the piston. These Figures illustrate the inventive transmission mechanism in the application with an internal combustion engine; however, it will be understood that the invention can also have application to other reciprocating piston machines, such as a compressor or a pump. Furthermore, the internal combustion engine can be made to run as an Otto cycle, diesel cycle, or dual cycle in manners known in the art. Since the charging, firing, and exhaust mechanisms for the internal combustion engines illustrated may be of conventional, known type, a detailed description of these features is not necessary.

FIGS. 1–4 illustrate a first embodiment of the present invention. With reference to these Figures, an internal combustion engine 10 is provided with a vertically directed cylinder casing 11 defining a cylinder chamber space 12 by virtue of top and sidewall portions. The cylinder 11 is disposed on a crankcase 13 defining an open interior volume which communicates with the cylinder chamber 12. The engine 10 is of a diesel type, such that the cylinder is provided with pressurized air port means 14 and exhaust gas discharge port means 15. A diesel fuel inlet port means 16 extends through the top surface of the cylinder 11.

A piston head 17 is disposed for reciprocation within the cylinder chamber 12 to define a variable volume working space between the upper surface of the piston 17 and the top surface of the cylinder 11. In accordance with the invention, the piston 17 is moved back and forth within the cylinder chamber 12 in true straightline motion, that is, by application of a driving force directly and solely applied at the piston along the longitudinal axis of the cylinder chamber 12. Rigidly connected to the undersurface of the piston 17 is a translator element 18 disposed in a longitudinal plane defined by the cylinder chamber 12. The translator element 18 is formed with a vertically directed neck portion 19 connected at its upper end with the piston 17 and formed at its lower end with a relatively enlarged base portion 20 which is disposed within the interior volume of the crankcase 13.

A pair of cam means 21 in the form of discs journaled for rotation in the translator element base 20 are disposed on opposed sides of the longitudinal axis of the cylinder chamber 12, each equadistantly spaced from the longitudinal axis. These discs are adapted for eccentric rotation in relatively opposite directions within the corresponding journal spaces of the translator base 20 to provide the back and forth straightline movement of the translator element 18.

Figure 2:
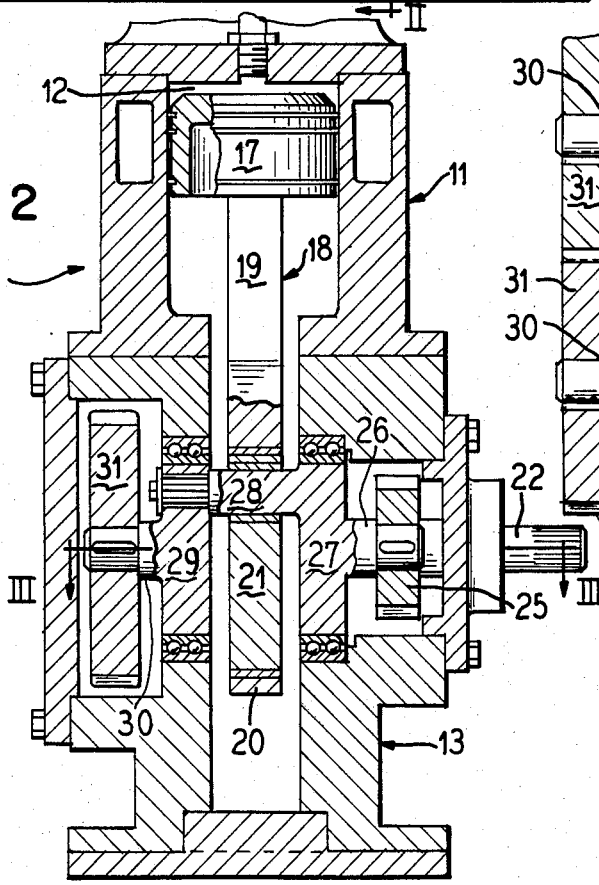
FIG. 2 is a cross-sectional view taken along the lines II—II of FIG. 1.
Figure 3:
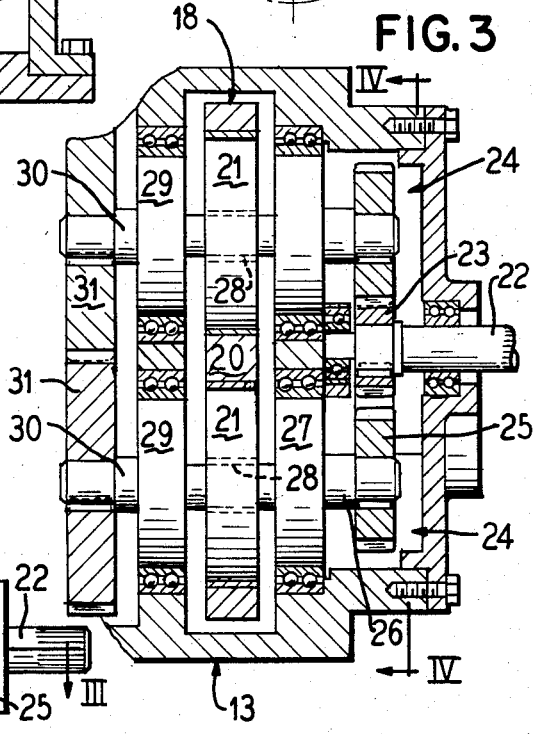
FIG. 3 is a cross-sectional view taken along the lines of III—III of FIG. 2.

With reference to FIGS. 2–3, the arrangement for bringing about the opposite sense rotation of the discs 21 will be described. A rotatable driveshaft 22 is supported within the crankcase 13 and formed with a drive gear 23 disposed coaxially between a pair of parallel extending drive transmission trains 24, each respectively coinciding with a corresponding one of the rotatable discs 21. Each of the drive transmission trains 24 is identically constructed, such that one need only be described. A rotatable pick-up gear 25 keyed for rotation on a shaft 26 is drivingly engaged with the driveshaft gear 23 on one side thereof. The shaft 26 rotates a wheel 27 having an eccentric arm 28 extending linearly outward adjacent an edge of the wheel 27 in a direction which perpendicularly intersects with the longitudinal plane in which the translator element 18 is disposed. The eccentric arm 28 extends through the translator base 20 in a journaled opening disposed through and eccentrically of the corresponding rotatable disc 21. The eccentric arm 28 extends through the translator element 18 for eccentric connection with a rotatable wheel 29 having a diameter equal to that of the wheel 27 and disposed for rotation on the opposite side of the translator element 18 about a common linear axis of rotation with that of the wheel 27. The bearing journal supports for the wheels 27 and 29 can be brought relatively close to the cylinder linear axis due to the controlled straightline movement of the translator element 18, such that the engine transmission mechanism does not require excess structure or interior spacing and can handle relatively higher pressure loads due to reduced moment arm lengths. The wheel 29 is formed with a further linearly extending stub shaft 30 rotatable about the axis of the wheel 29 and formed with a relatively enlarged balance gear 31. The balance gears 31 of the drive transmission trains 24 directly intermesh with one another, as shown in FIG. 3, to coincide the rotational movement of the drive trains 24 with one another.

It will be noted that the eccentric arm 28 and its opposed end wheel connections 27 and 29 may be in the form of a conventional crankarm assembly eliminating the need for the large journal supports for the wheels 27 and 29 by instead rotatably supporting the shaft portions 26 and 30. However, this crankarm arrangement does not afford the higher strength support features resulting from the version shown in FIGS. 1–3.

By virtue of this arrangement, the drive trains 24 rotate with the same relative movement, but in opposite directions of one another. As a result of this contra or mirror image rotation of the drive trains 24, the engine 10 is in complete balance. The movement of the eccentric arm 28 causes rotation of the corresponding disc 21 within its journaled space in the translator element base 20, such that the translator element 18 is effected with back and forth movement directed solely along the longitudinal axis of the cylinder chamber 12 and this movement is imparted to the piston 17. For bringing about this movement, the portions 25–28 of each drive train 24 serves as a crankshaft means disposed on opposite sides of the longitudinal axis of the cylinder chamber 12 and equadistantly spaced from that longitudinal axis. Because of the straightline motion imparted to the piston 17, sidewall pressure by the piston 17 on the chamber sidewalls of the cylinder 11 is eliminated, which reduces debilitating friction and preserves the cylinder wall oil film. Much greater compression ratios are achievable with any power input by the driveshaft 22, since combustion pressure is distributed on two crankshaft means, instead of one as is conventional, and due to the elimination of cylinder sidewall friction.

Figure 5:
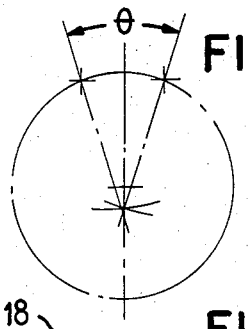
FIG. 5 is a graphic illustration of the angle portion of crankshaft rotation at which a piston will remain at top dead center by virtue of the present invention.

The relative eccentricity of the eccentric arm 28 relative to the linear axis of the disc 21 may be varied in order to tailor the timing of the piston stroke. Accordingly, as shown in FIG. 5, the designer is able to adjust the angle $\theta$ of crankshaft means rotation during which the piston will remain at top dead center. As shown in the drawings, this angle is set to preferably be about 40 degrees of the full circle of crankshaft means rotation.

This inventive arrangement boosts the horsepower and efficiency of the engine 10, since a higher compression is achieved in the cylinder. The compression stage is enhanced by a longer period of dwell time afforded the piston at top dead center by virtue of the eccentric rotation of the cam discs 21 as shown in FIG. 1. Correspondingly, the position of the eccentric arms in the cam discs 21 could be adjusted by 180° as shown in FIG. 1 for the top dead center stage of piston movement to construct an inventive crankshaft means which affords enhanced dwell time for the piston at bottom dead center, such as to permit more time for cylinder evacuation of exhaust gases in contrast to an enhanced compression stage. Due to the use of eccentrically rotated discs in this embodiment, much shorter piston strokes can be utilized to achieve greater rpm without increasing piston speed. The higher achievable compression renders an internal combustion engine adapted with the inventive arrangement to run with virtually any fuel, such as liquid, powder, or gas, that can be injected to burn completely at top dead center, since the higher achievable compressions also raise the working space temperature to significantly higher levels. This would also make possible use of the inventively adapted engine to run on a hydrogen-oxygen reaction.

Figure 4:
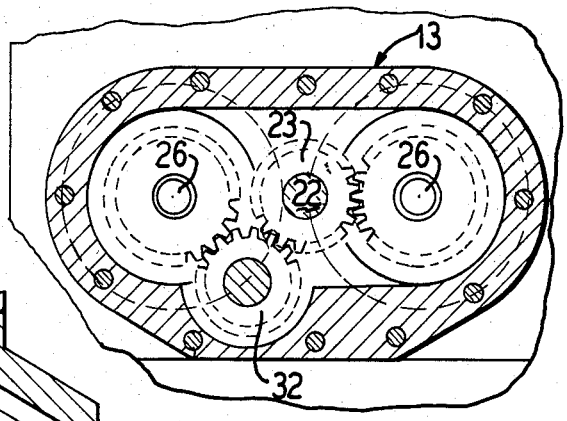
FIG. 4 is a cross-sectional view taken along the lines of IV—IV of FIG. 3.

Since the drive trains 24 of both crankshaft means are geared together by the balance gears 31, an idler gear 32, as shown in FIG. 4, is disposed between the pick-up gear 25 of one drive train 24 and the drive gear 23 to enable relative contra-rotation of the drive trains 24. An additional power take-off may be taken from either crankshaft means since both drive trains 24 are co-balanced and co-rotating.

Figure 6:
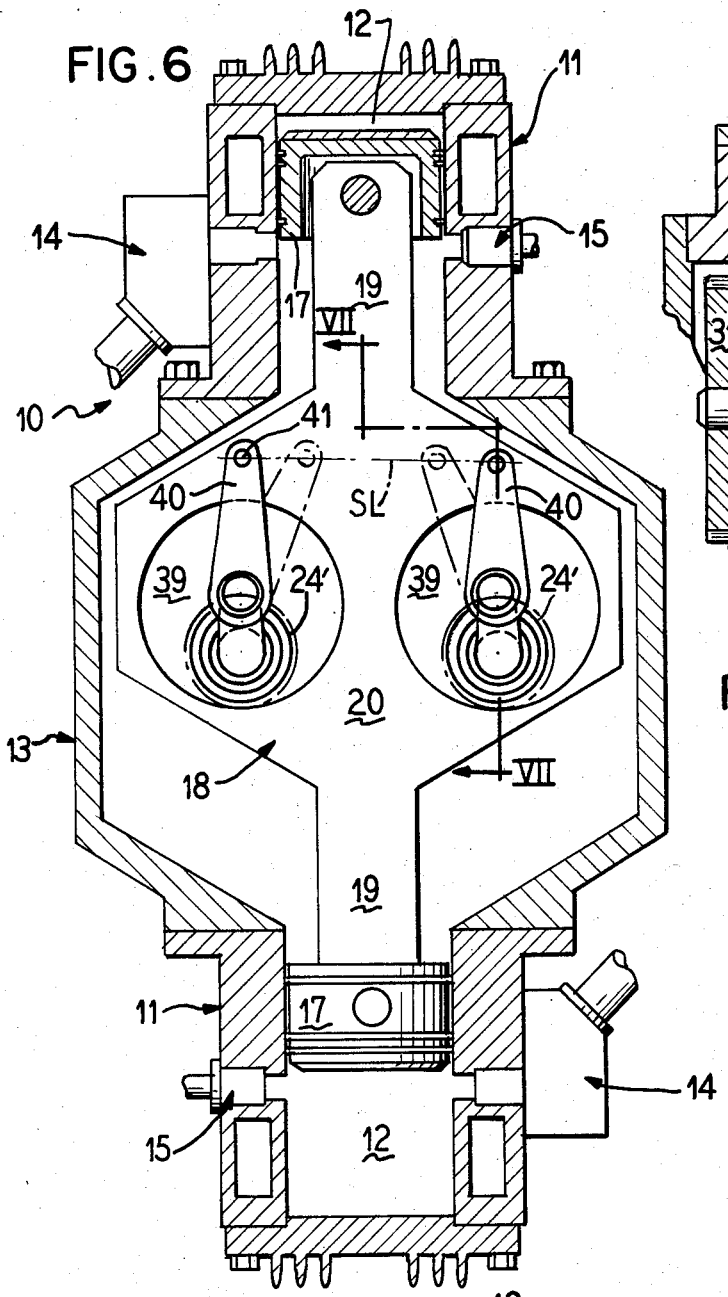
FIG. 6 is a cross-sectional side elevational view of an internal combustion piston engine constructed in accordance with a second embodiment of the invention.
Figure 7:
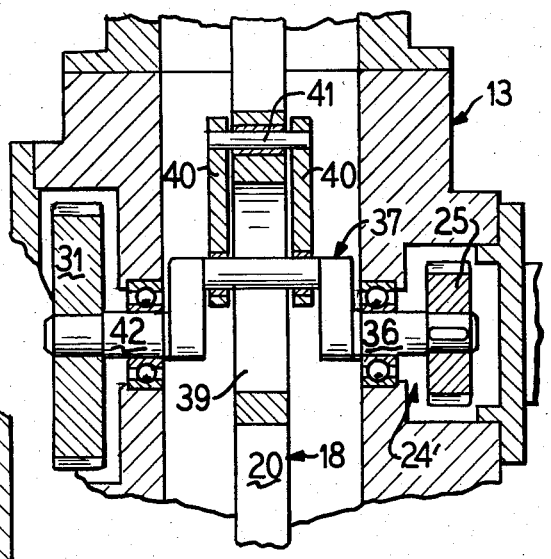
FIG. 7 is a cross-sectional view taken along the lines of VII—VII of FIG. 6.

The arrangement of the first embodiment may be used to operate a single piston as shown or operate a pair of opposed pistons connected with the translator element 18. FIGS. 6–7 illustrate a second embodiment of the invention in which the internal combustion engine 10 is provided with a pair of opposed cylinders 11 in which a pair of oppositely acting pistons 17 respectively reciprocate. The construction of the engine 10 and translator element 18 is similar to that of the first embodiment, such that like reference numerals are used and repeated features will not again be described. This second embodiment of the invention utilizes a modified drive train crankshaft means for effecting the true straightline motion of the translator element 18 along the longitudinal axes of the cylinder spaces 12 contained in the directly opposed cylinders 11. As in the case of the first embodiment, a pair of oppositely rotatable crankshaft means are disposed on opposed sides of the longitudinal axes of the opposed cylinder spaces 12. Since the construction of each crankshaft is identical, only one will be described with reference to FIG. 7.

The modified drive train labeled 24' commences with the pick-up gear 25 in the manner of the first embodiment. The pick-up gear 25 is keyed for rotation on a linearly directed shaft 36 which rotates a crankshaft piece 37 having a linearly directed crosspiece offset from the axis of rotation of the shaft 36 and extending through the plane of the translator element 18. The base 20 of the translator element 18 is formed with a circular hollow space 39 in which the crankshaft crosspiece 38 is rotated. Here, a pair of connecting rods 40 are disposed on opposed sides of the translator element base 20, journaled for rotation at their lower ends about the axis of the crosspiece 38 and journaled for rotation at their upper ends on a common pin 41 journaled linearly through the translator base wall 20. While an opposed pair of connecting rods 40 are illustrated associated with each crankshaft piece, it will be understood that a single rod 40 may be used or that a U-shaped piece having its base end journaled on the crosspiece 38 and its arms journaled at opposed ends of the pin 41 may be used instead of two separate rods. The crankshaft piece 37 operates in the manner of the eccentric arm 28 described above and the connecting rod assembly 40,41 serves as the cam means in place of the eccentrically rotated discs 21 described above.

The crankshaft 37 is connected for rotation at its end opposite the shaft 36 with a further shaft 42 disposed for rotation about the same axis of rotation as the shaft 36 and having a diameter identical to the shaft 36. The shaft 42 serves to rotate the balance gear 31.

As in the manner of the first embodiment, portions 25 and 36–41 of the drive train 24' serve as a crankshaft means by which rotational movement of the driveshaft 22 is imparted as solely linear back and forth motion to the translator element 18 and the pistons 17 in true straightline fashion along the longitudinal axis of the directly opposed cylinder chambers 12.

Figure 8:
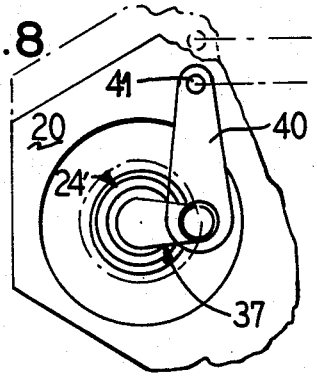
FIG. 8 is a fragmentary front elevational view showing a connecting rod of the transmission mechanism of FIG. 6 pinned in a first predetermined position on the translator element.
Figure 9:
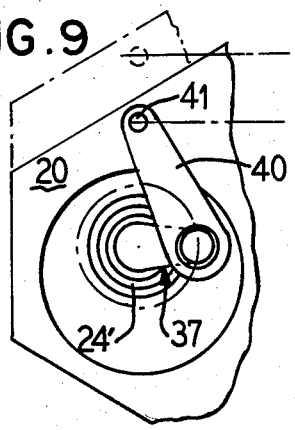
FIG. 9 is a fragmentary front elevational view showing a connecting rod of the transmission mechanism of FIG. 6 pinned at a second predetermined position on the translator element.

The features and advantage of the first embodiment also apply to this second embodiment. However, to vary the timing in the piston operation, the designer adjusts the position at which the connecting rod pin 41 is disposed through the translator base 20 relative to the longitudinal axis of the opposed cylinder chambers 12 and along an imaginary horizontal line SL perpendicular to the cylinder axis. As in the case of the first embodiment, the crankshaft means of the drive train pairs 24' are oppositely rotating and disposed on opposed sides of the cylinder chamber longitudinal axis, equadistantly spaced from that longitudinal axis. The location of the pins 41 are set to be equadistantly spaced from the longitudinal axis of the cylinder chambers 12 along the line SL; however, that distance may be selected as necessary to be closer to or further from the longitudinal axis, as shown in FIGS. 8 and 9, in order to vary the portion of angle of rotation of the crankshaft means circle at which the piston 17 remains at top dead center in its cylinder 11.

Figure 10:
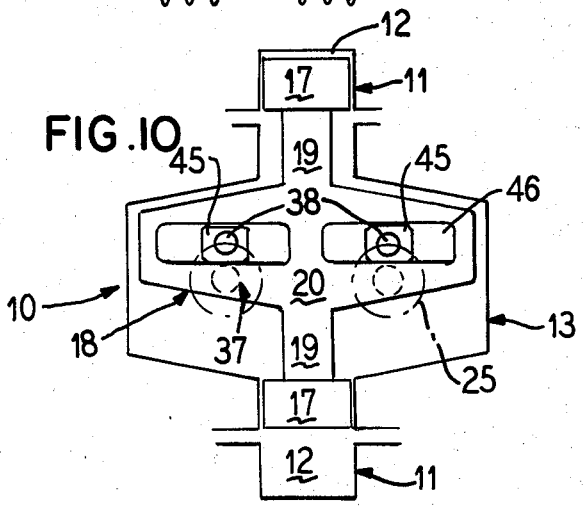
FIG. 10 is a schematic, cross-sectional view illustrating an internal combustion piston engine constructed in accordance with a third embodiment of the invention.

FIG. 10 illustrates a third embodiment of the invention similar to that of the second embodiment, except that the connecting rod and pin cam means 40,41 are replaced by a pair of slider elements 45, each journaled about the eccentric arm crankshaft crosspiece 38 of a respective one of the pair of drive train crankshaft means. Each slider element 45 is disposed for lateral movement perpendicular to the longitudinal axis of the cylinder chambers 12 within a laterally directed track space 46 formed in the base portion 20 of the translator element 18.

The crankshaft means in this embodiment are likewise oppositely rotating and disposed on opposed sides of the longitudinal axis of the opposed cylinder chambers 12. This transmission arrangement also causes the translator element 18 and the pistons 17 to be imparted with back and forth movement in a true straightline motion along the longitudinal axis of the opposed cylinder chambers 12, affording the above-described advantages in operation of the engine 10.

Figure 11:
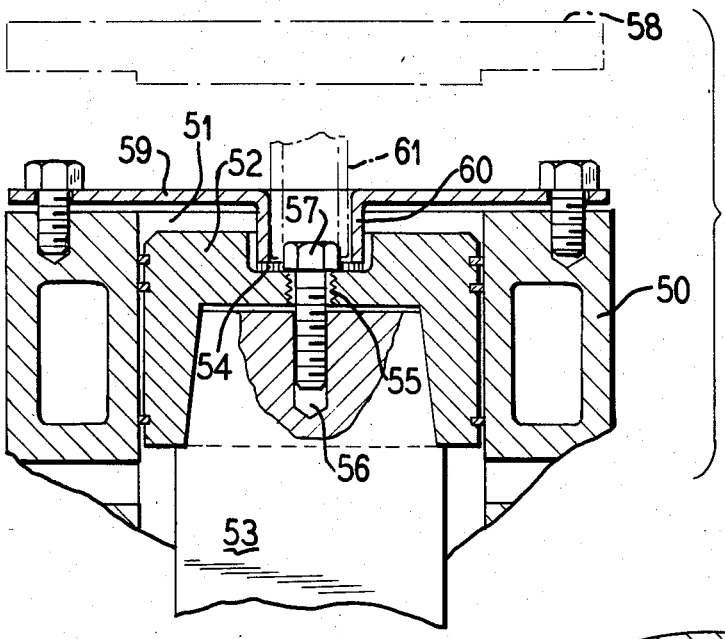
FIG. 11 is a fragmentary cross-sectional, side elevational view illustrating a piston head removal assembly instructed in accordance with the invention.
Figure 12:
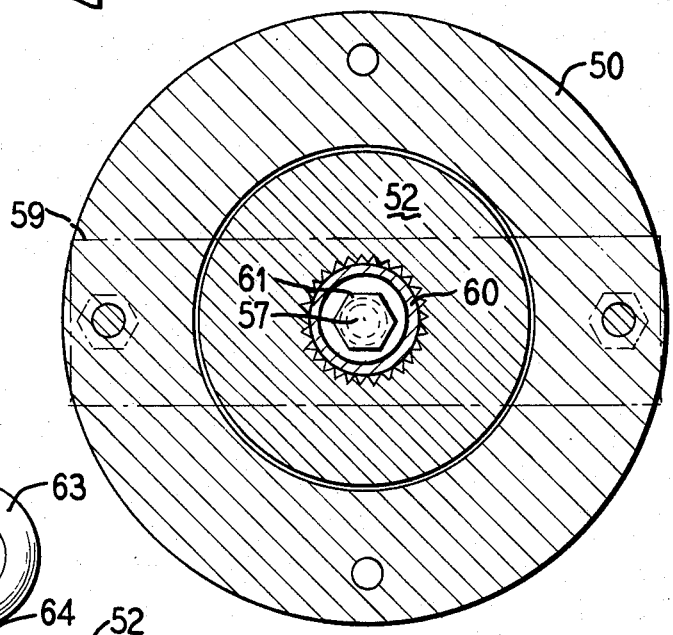
FIG. 12 is a cross-sectional view taken along the lines of XII—XII of FIG. 11.
Figure 13:
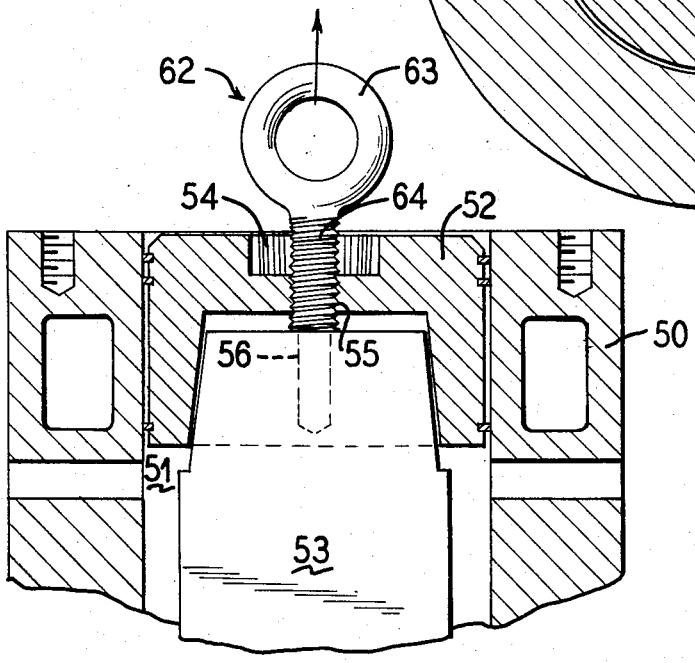
FIG. 13 is a fragmentary cross-sectional, side elevational view illustrating the application of a special tool for removing the piston from the cylinder of FIG. 11.

FIGS. 11–13 are directed to an inventive system for removing a piston head from an engine cylinder for maintenance purposes. This system is especially practical for pistons operated in straightline motion since it is necessary that the fastening devices associated with the piston head be accessible and removable in a direction parallel with the longitudinal axis of the cylinder.

In accordance with this piston removal invention, a cylinder 50 defines a cylinder chamber 51 in which a piston 52 is disposed on the free end of a translator mechanism 53 for imparting back and forth reciprocal motion to the piston in the cylinder, preferably in a straightline fashion along the longitudinal axis of the cylinder. The piston 52 is formed with a central recess 54 defined by serrated longitudinal sidewalls extending inward from the upper surface of the piston. Extending longitudinally through the piston from the bottom of the recess 54 is a threaded bore 55 communicating at its open lower end with a connector portion of the translator mechanism 53. The connector portion of the translator 53 has a threaded bore 56 aligned with the longitudinal axis of the piston bore 55, such that a bolt 57 can be easily passed through the piston threaded bore 55 into engagement with the translator threaded passage 56. The enlarged head of the bolt 57 presses against the bottom wall of the piston recess 54 upon tightening of the bolt 57 so as to removably fasten the piston 52 to the translator 53.

In order to permit removal of the piston out of the cylinder, the head plate of the cylinder 58 is made removable along the longitudinal axis of the cylinder. The normal cylinder head plate 58 is replaced by a special mounting plate 59, which may be fastened by bolts across the top of the cylinder 50 as shown in FIGS. 11–12. The mounting plate 59 is formed with a centrally disposed longitudinally extending passage defined by a sidewall 60 formed with exterior serrations for lockingly engaging the piston recess sidewall serrations to hold the piston 52 against twisting in the cylinder chamber. At this step of the piston removal operation, the piston 52 is preferably disposed at its top dead center position in the cylinder.

A wrench 61, such as a socket wrench, is passed longitudinally through the top of the cylinder 50 and through the interior of the mounting plate passage to engage with the head of the bolt 57. The wrench may then be rotated to remove the bolt 57 from the translator passage 56 and thus free the piston 52 from attachment with the translator 53.

It will be noted that the diameter of the piston threaded bore 55 is substantially greater than the diameter of the threaded portion of the bolt 57, such that the bolt shank can be easily passed through the piston bore for engagement with the translator threaded passage 56 and also to prevent deformation of the threads in the piston bore 55 which are used to permit the piston to be lifted out of the cylinder.

As shown in FIG. 13, the mounting plate 59 is removed from attachment to the top of the cylinder 50 after the bolt connection 57 has been removed. At this point, with the piston 52 seated freely on the connection portion of the translator mechanism 53, a special screw element tool 62 having a ring-shaped upper end 63 to permit manual turning and a downwardly extending screw threaded shank 64, is applied to the piston 52 to access the piston out of the cylinder. The threaded shank 64 of the tool 62 is specially sized to permit mating engagement with the threaded bore 55. The shank 64 is screwed into the piston bore 55, such that the shank passes through the bore 55 to engage the upper surface of the translator 53. At this point, the operator is aware that the tool shank 64 has fully engaged the threaded bore 55 of the piston. Then, the operator simply lifts the tool upper end at the ring 63 in a direction parallel with the longitudinal axis of the cylinder such that the piston is drawn out of the cylinder, permitting maintenance or replacement of the piston, as well as visual inspection of the cylinder interior.

Although various minor modifications may be suggested by those versed in the art, it should be understood that I wish to embody within the scope of the patent warranted hereon all such modifications as reasonably and properly come within the scope of my contribution to the art.

1. A reciprocating piston machine comprising a piston reciprocably movable in a cylinder having a crankcase and fluid inlet and outlet means connected thereto, a pair of oppositely rotatable crankshaft means disposed on opposed sides of the longitudinal axis of said cylinder within said crankcase and each crankcase means having an eccentric arm intersecting with a longitudinal plane of said cylinder, a one-piece translator means disposed in said longitudinal plane extending from said cylinder into said crankcase for moving in a true straightline motion along said longitudinal axis, said translator means being connected to said piston for moving said piston in said cylinder and being spaced from said cylinder and said crankcase, a pair of rotary cam means respectively disposed for free eccentric rotation about each said eccentric arm and for free rotation on said translator means and arranged between each said eccentric arm and said translator means on opposite sides of said longitudinal axis along said longitudinal plane and relatively and differently movable of both said translator means straightline motion and said eccentric arm rotation for effecting said motion of said translator means, and a balance gear means connected to said eccentric arms for coinciding the rotation of said pair of crankshaft means.

2. The machine of claim 1, wherein said cylinder defines an internal combustion engine.

3. The machine of claim 1, wherein each said cam means is a disc journaled for rotation in said translator means and eccentrically rotated about said respective eccentric arm.

4. The machine of claim 1, wherein said piston remains at top dead center in said cylinder for substantially 40° of rotation of said crankshaft means.

5. The machine of claim 1, wherein said pair of crankshaft means are drivingly connected to a common driveshaft disposed for rotation therebetween.

6. The machine of claim 1, wherein said balance gear means comprises a pair of intermeshing gear wheels.

7. The machine of claim 1, further comprising another cylinder, having further fluid inlet and outlet means connected thereto, aligned on said longitudinal axis and another piston connected with said translator means which further extends into and is spaced from said another cylinder.

8. The machine of claim 1, wherein said translator means is in free-standing connection with said piston, so as to be free from requiring guide supports.

9. The machine of claim 1, wherein each said cam means comprises a connecting rod rotatable at its outer end about a pin journaled through said translator means and at its inner end about said respective eccentric arm.

10. The machine of claim 9, wherein said pins for said pair of cam means are equidistantly spaced from said longitudinal axis at a predetermined distance which determines the time at which said piston is at top dead center in said cylinder.

11. An internal combustion engine comprising a piston reciprocable movable in a cylinder having a crankcase and fluid inlet and outlet means connected thereto, a pair of oppositely rotatable crankshaft means disposed on opposite sides of the longitudinal axis of said cylinder within said crankcase and each crankcase means having an eccentric arm intersecting with a longitudinal plane of said cylinder, a translator means disposed in said longitudinal plane extending from said cylinder into said crankcase for moving in a true straightline motion along said longitudinal axis, said translator means being connected to said piston for moving said piston in said cylinder in free-standing connection spaced from said cylinder and said crankcase so as to be free from requiring guide supports, a pair of rotary cam means respectively disposed for free eccentric rotation about each said eccentric arm and for free rotation on said translator means and arranged between each said eccentric arm and said translator means on opposite sides of said longitudinal axis along said longitudinal plane and relatively and differently movable of both said translator means straightline motion and said eccentric arm rotation for effecting a true straightline movement of said translator means and said piston along said longitudinal axis for relatively greater horsepower efficiency.

12. The engine of claim 11, wherein each said cam means is a disc journaled for rotation in said translator means and eccentrically rotated about said respective eccentric arm.

13. The engine of claim 11, wherein said piston remains at top dead center in said cylinder for substantially 40° of rotation of said crankshaft means.

14. The engine of claim 11, wherein said pair of crankshaft means are drivingly connected to a common driveshaft disposed for rotation therebetween.

15. The engine of claim 11, further comprising a pair of intermeshed balance gears, each drivingly connected to one respective said eccentric arm for coinciding rotation of said pair of crankshaft means.

16. The engine of claim 11, further comprising another cylinder, having further fluid inlet and outlet means connected thereto, aligned on said longitudinal axis and another piston connected with said translator means which further extends into and is spaced from said another cylinder.

17. The engine of claim 11, wherein said cylinder has a removable head surface facing directly across from the upper surface of said piston and said piston is screw-attached to said translator means by a screw means extending parallel with said longitudinal axis.

18. The engine of claim 11, wherein each said cam means comprises a connecting rod rotatable at its outer end about a pin journaled through said translator means and at its inner end about said respective eccentric arm.

19. The engine of claim 18, wherein said pins for said pair of cam means are equidistantly spaced from said longitudinal axis at a predetermined distance which determines the time at which said piston is at top dead center in said cylinder.

* * * * *